US008020862B2

(12) United States Patent
Oyama et al.

(10) Patent No.: US 8,020,862 B2
(45) Date of Patent: Sep. 20, 2011

(54) SHEET CONVEYANCE DEVICE, IMAGE FORMING APPARATUS AND IMAGE READING APPARATUS

(75) Inventors: Kiyoshi Oyama, Tokyo (JP); Yusuke Imai, Toride (JP); Toshifumi Itabashi, Toride (JP); Takuma Koizumi, Toride (JP); Ayumu Murakami, Abiko (JP); Yuichi Yamamoto, Toride (JP); Haruhisa Oshida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 1053 days.

(21) Appl. No.: 11/833,341

(22) Filed: Aug. 3, 2007

(65) Prior Publication Data

US 2008/0030808 A1 Feb. 7, 2008

(30) Foreign Application Priority Data

Aug. 7, 2006 (JP) ..... 2006-214667

(51) Int. Cl.
*B65H 7/02* (2006.01)

(52) U.S. Cl. ..... 271/265.01; 271/225

(58) Field of Classification Search ..... 271/265.01, 271/255, 225

See application file for complete search history.

(56) References Cited

U.S. PATENT DOCUMENTS

| | | | | |
|---|---|---|---|---|
| 3,873,196 | A * | 3/1975 | Ogawa | 399/76 |
| 4,157,822 | A * | 6/1979 | Miller | 271/3.05 |
| 4,548,394 | A * | 10/1985 | Koyama et al. | 271/9.11 |
| 6,102,392 | A * | 8/2000 | Gleichauf et al. | 271/265.02 |
| 2005/0206069 | A1 | 9/2005 | Yamamoto | 271/117 |
| 2005/0279996 | A1* | 12/2005 | Takubo et al. | 257/40 |
| 2006/0220305 | A1 | 10/2006 | Serizawa et al. | 271/262 |
| 2007/0273083 | A1 | 11/2007 | Imai | 271/152 |
| 2008/0030809 | A1* | 2/2008 | Itabashi et al. | 358/498 |
| 2008/0030810 | A1* | 2/2008 | Murakami et al. | 358/498 |
| 2009/0050815 | A1* | 2/2009 | Miyata et al. | 250/370.09 |

FOREIGN PATENT DOCUMENTS

JP 7-053087 2/1995

* cited by examiner

*Primary Examiner* — Stefanos Karmis
*Assistant Examiner* — Howard Sanders
(74) *Attorney, Agent, or Firm* — Fitzpatrick, Cella Harper & Scinto

(57) ABSTRACT

A sheet conveyance device according to an aspect of the invention includes a guide member and a flexible guide assist member. The guide member constitutes a conveyance path for guiding a conveyed sheet. The guide assist member is provided in the guide member, the guide assist member is brought into contact with the conveyed sheet to apply a force to the sheet, and whereby the guide assist member assists the guidance of the sheet conveyance. The sheet conveyance device is characterized in that a sheet scanner is provided in the guide assist member. In the sheet scanner, photoelectric conversion devices formed by organic semiconductor devices are arranged.

7 Claims, 8 Drawing Sheets

SHEET CONVEYANCE DEVICE, IMAGE FORMING APPARATUS AND IMAGE READING APPARATUS

BACKGROUND OF THE INVENTION

1. Field of the Invention

The present invention relates to a sheet conveyance device for conveying a sheet and an image forming apparatus or an image reading apparatus provided with the sheet conveyance device.

2. Description of the Related Art

Recently, in the image forming apparatus such as a printer and a copying machine, a sheet detection sensor is arranged to detect a sheet in a sheet conveyance path. The sheet detection sensor detects a position of the sheet conveyed along a guide member constituting the sheet conveyance path. In the image forming apparatus, an image is formed in synchronization with sheet conveyance timing based on the detection result of the sheet detection sensor, which prevents image defects such as image position shift on the sheet. In the case where the sheet cannot be detected at predetermined conveyance timing due to sheet jam in the conveyance path, a sheet conveyance operation is stopped at an early stage to reduce a quantity of user's work for removing the hammed sheet. Additionally, the jammed sheet is prevented from having damage to the apparatus.

There is known a configuration in which, in addition to the sensor, a flexible guide assist member is provided in a guide member constituting the conveyance path in order to restrain the generation of the jam. The guide assist member is provided in the conveyance path while inclined toward a sheet conveyance direction, and the guide assist member prevents the sheet jam by restraining a behavior in a surface direction of the curled sheet having insufficient flatness.

Sometimes the sheet conveyance path in the image forming apparatus is formed by plural conveyance units which are detachably attached to the image forming apparatus. In such cases, sometimes the jam is generated because the conveyance path position of the conveyance unit located on an upstream side in the conveyance direction is shifted from the conveyance path position of the conveyance unit located on a downstream side by a fluctuation of position accuracy. Even in such a configuration, the guide assist member is provided so as to be extended from one conveyance unit to the other conveyance unit, which strains the jam due to the position shift of the conveyance path to perform the good conveyance.

In the case where the apparatus having the plural conveyance units is stopped by detecting the sheet jam, sometimes the apparatus is stopped while the jammed sheet straddling the plural conveyance units. At this point, in the configuration in which each conveyance unit may be drawn in a direction orthogonal to the sheet conveyance direction, when the conveyance unit is drawn in removing the sheet, the sheet is possibly broken between the conveyance units and jammed in the conveyance path, or the guide member constituting the conveyance path is possibly deformed.

Therefore, in order to prevent the above situations, there is disclosed a technique in which a sensor is provided to detect the sheet which is stopped while straddling the conveyance units in addition to the sensor provided in each conveyance unit (for example, see Japanese Patent Laid-Open No. 7-53087). According to the technique disclosed in Japanese Patent Laid-Open No. 7-53087, when the sensor determined that the sheet is stopped while straddling the conveyance units, the conveyance units which the sheet straddles are simultaneously drawn while coupled by a solenoid, and a user performs a jam clearance operation.

A type in which a translucent sensor detects fall of a retractable lever when the sheet abuts on the retractable lever projected in the conveyance path during the sheet conveyance is known as the conventional sheet detection sensor used in the apparatus (hereinafter referred to as lever sensor type). A type in which the presence or absence of the sheet is directly read in a noncontact and optical manner by providing an optical sensor including a light emitting portion and a light acceptance portion in the conveyance path is also known as the conventional sheet detection sensor (hereinafter referred to as optical sensor type).

In the conventional sheet detection sensor, the lever sensor type needs a lever, a translucent type sensor, and a configuration in which the lever and the translucent type sensor are attached into the conveyance path. The optical sensor type needs a sensor for the light emitting portion, a sensor for the light acceptance portion, and a configuration in which the sensors are attached into the conveyance path. Therefore, an installation space is required to attaché the sensors and the configuration in which the sensors are attached into the conveyance path, which blocks downsizing of the apparatus.

In the conventional technique, the sheet detection sensor and the guide assist member are separately disposed in the conveyance path. In order to enhance the accuracy of sheet detection, preferably the sensor is disposed near the guide assist member which restrains flutter of the sheet during the conveyance. However, because the sensor needs the installation space, it is necessary that the sensor be separated away from the guide assist member. Therefore, the sheet is detected in the fluttering state, which worsens the accuracy of detection in the sheet particularly having the bad flatness

SUMMARY OF THE INVENTION

The present invention provides a sheet conveyance device, an image forming apparatus and an image reading apparatus which improve accuracy of sheet detection while achieving space-saving in a space to which the sheet detection unit is attached.

A sheet conveyance device according to an aspect of the invention includes a conveyance path which guides a conveyed sheet; a flexible guide assist member which is provided in the conveyance path to assist guidance of the conveyed sheet, and a sheet detection unit, arranged in the guide assist member, which detects the conveyed sheet, wherein the sheet detection unit has photoelectric conversion devices formed by organic semiconductor devices.

DESCRIPTION OF THE PREFERRED EMBODIMENT

Exemplary embodiments of the invention will be described in detail below with reference to the accompanying drawings. However, sizes, materials, and shapes of component and a relative arrangement of components described in the following embodiments should appropriately be changed according to a configuration and various conditions of an apparatus to which the invention is applied. Accordingly, the scope of the invention is not limited to the embodiments unless particularly stated.

First Embodiment

Figure 1:
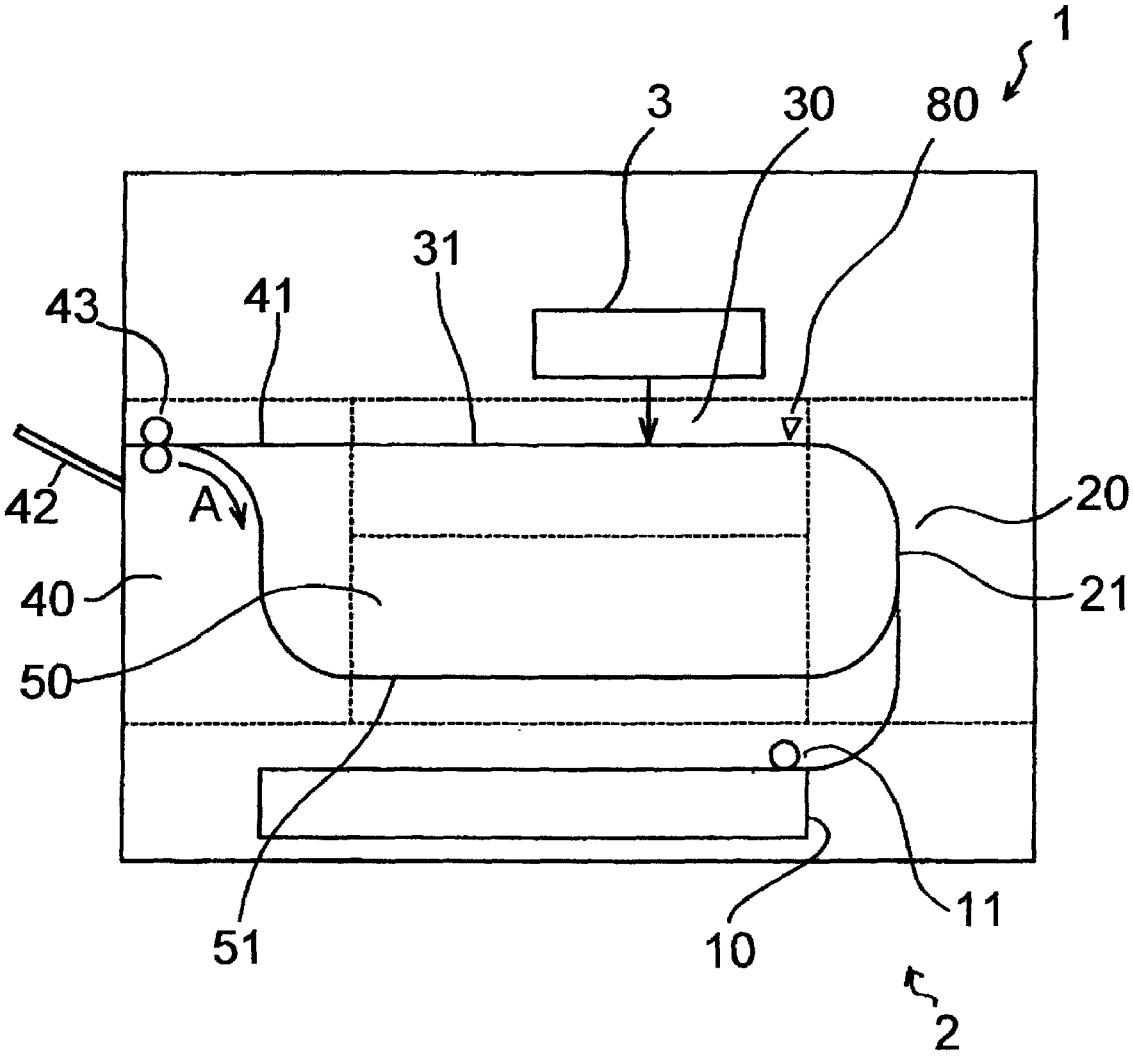
FIG. 1 illustrates a schematic configuration of an image forming apparatus provided with a sheet conveyance device.
Figure 2:
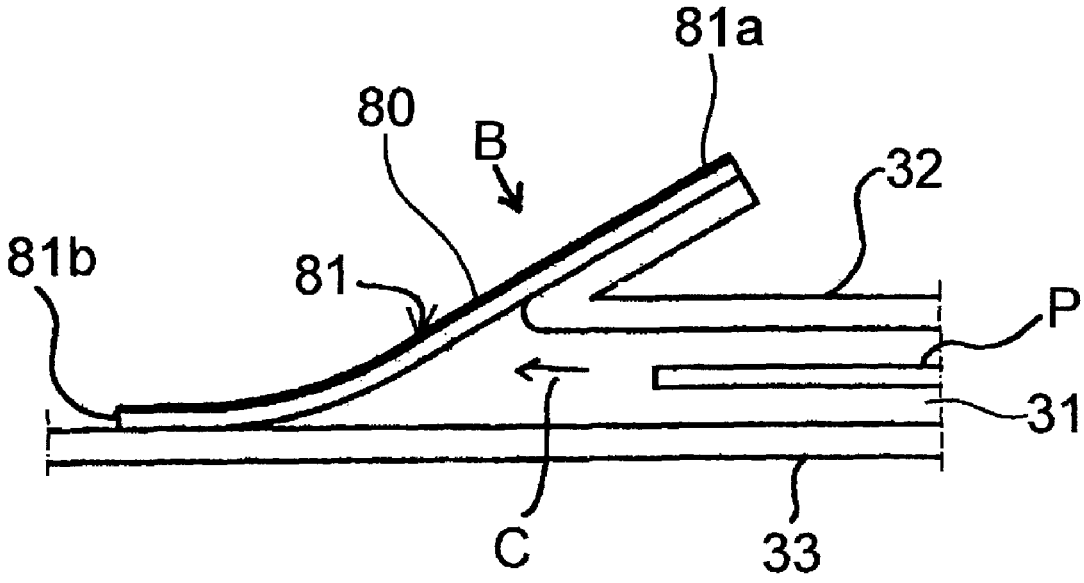
FIG. 2 is a detailed sectional view illustrating a sheet conveyance device according to a first embodiment of the invention.

An image forming apparatus provided with a sheet conveyance device according to a first embodiment of the invention will be described with reference to FIGS. 1 to 3. FIG. 1 illustrates a schematic configuration of the image forming apparatus, FIG. 2 is a detailed sectional view illustrating a configuration around a sheet detection sensor, and FIG. 3 illustrates a configuration of the sheet detection sensor in which photoelectric conversion devices formed by organic semiconductor devices are arranged.

A schematic configuration of the image forming apparatus will briefly be described with reference to FIG. 1. Referring to FIG. 1, an image forming apparatus 1 includes image forming unit 3 for forming an image on a sheet, a sheet cassette 10 constituting a sheet conveyance device 2, and first to fourth conveyance units 20 to 50 having first to fourth conveyance paths 21 to 51 respectively.

The sheets stacked in the sheet cassette 10 are separated one by one by separation and delivery unit 11, and the sheet is conveyed to the first conveyance path 21 possessed by the first conveyance unit 20. Then, the sheet is conveyed to the second conveyance path 31 possessed by the second conveyance unit 30.

When the sheet reaches the second conveyance path 31 of the second conveyance unit 30, a leading end of the sheet is detected by a sensor 80 which is of the sheet detection unit. An image is formed on the sheet conveyed at predetermined timing from the detection information by image forming unit 100.

The sheet on which the image is already formed is conveyed to the third conveyance path 41 possessed by the third conveyance unit 40, and the sheet is directly discharged to a discharge tray 42 in a single-sided print mode.

In the case of a double-sided print mode, switchback of the sheet is performed by sheet inverting unit 43, and the sheet is conveyed to the fourth conveyance path 51 possessed by the fourth conveyance unit 50 in an arrow A direction. Then, the sheet passes through the fourth conveyance path 51, and the sheet is conveyed to the first conveyance path 21 of the first conveyance unit 20 again.

In the second conveyance path 31 of the second conveyance unit 30, the sheet is conveyed while the surface on which the image is already printed is oriented downward, and an image is formed on an upper surface by the image forming unit 3. Therefore, the images are printed on both the sides, and the sheet is discharged to the discharge tray 42 through the third conveyance path 41 of the third conveyance unit 40.

A characteristic part of the sheet conveyance device of the first embodiment will be described below with reference to FIG. 2 which illustrates the detailed configuration around the sensor 80. As shown in FIG. 2, the second conveyance path 31 of the second conveyance unit 30 is formed by a pair of guide members 32 and 33.

A flexible guide assist member 81 which may be elastically deformed is provided in an end portion of the guide member 32. The guide assist member 81 is disposed while inclined toward a sheet conveyance direction (arrow C direction), which allows flutter of a sheet P to be restrained by an elastic force. The guide assist member 81 is provided such that one end 81*a* is fixed to the guide member 32 while the other end 81*b* constitutes a free end.

The free-end side 81*b* of the guide assist member 81 is in contact with the guide member 33 which faces the guide member 32 whose one end 81*a* is fixed.

The sensor 80 which is of the sheet detection unit is provided in the upper surface of the guide assist member 81. The sensor 80 is a sheet-shape scanner (hereinafter referred to as sheet scanner) in which photoelectric conversion devices formed by combinations of organic transistors and organic photodiodes are arranged in a matrix shape. The organic transistor and the organic photodiode are of an organic semiconductor device. Each organic photodiode generates an electric current by irradiating each photoelectric conversion device (optical sensor) of the sheet scanner 80 with light.

Figure 3A:
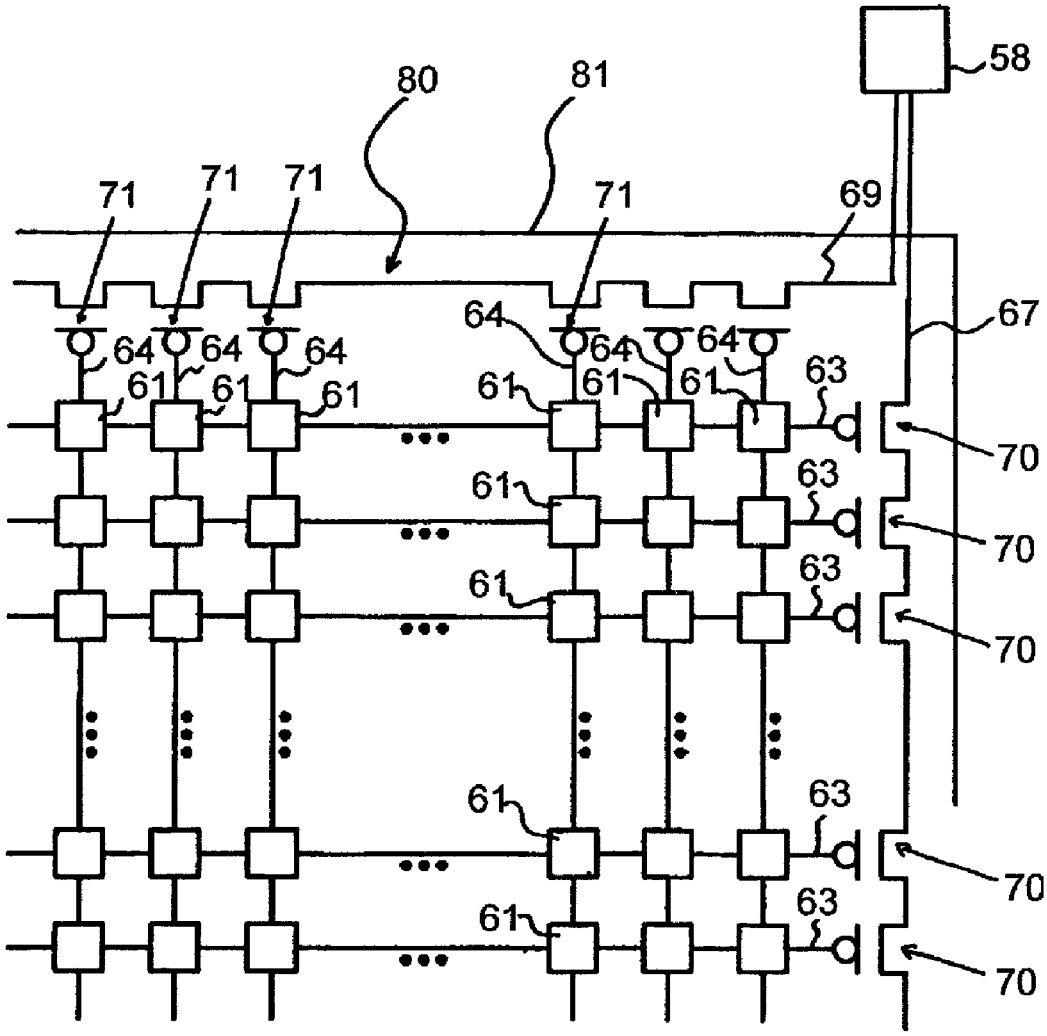
FIG. 3 is an explanatory view illustrating a sheet detection scanner in which photoelectric conversion devices formed by organic semiconductor devices are arranged in a matrix shape.
Figure 3B:
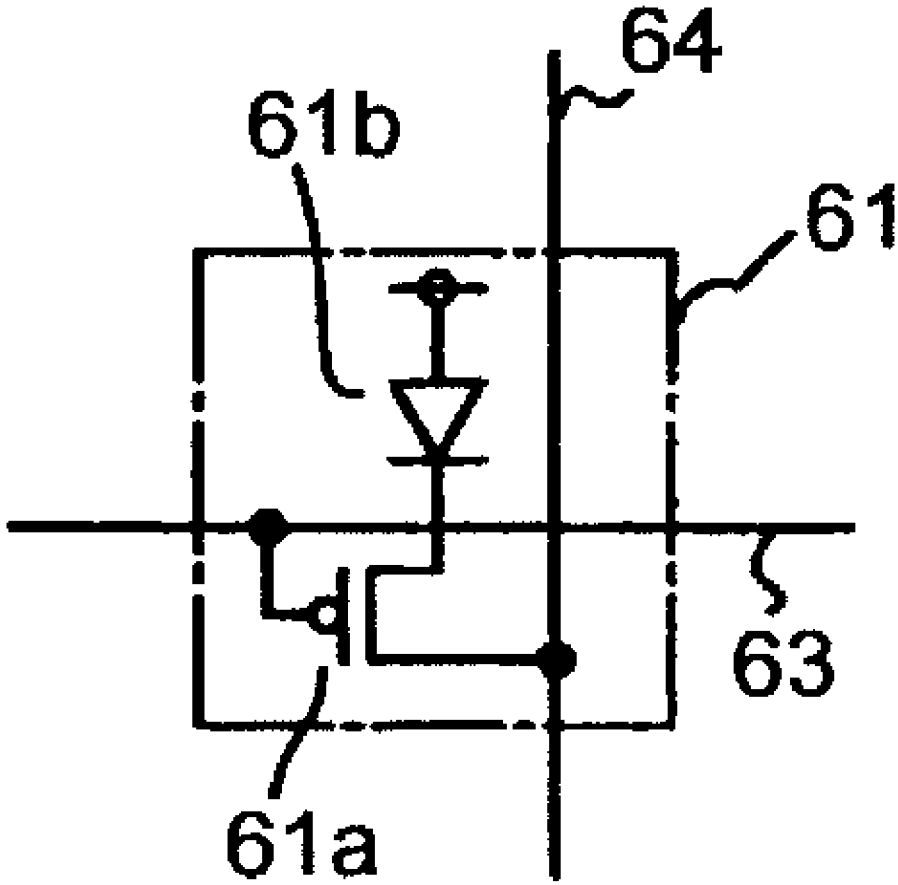

The sheet scanner 80 which is of the sheet detection sensor will be described with reference to FIG. 3. FIG. 3A illustrates a detailed guide assist member 81 when viewed from an arrow B direction of FIG. 2, and FIG. 3A is a schematic view describing a circuit configuration of the sheet scanner in which the optical sensors (reading pixels) formed by the organic semiconductor devices are arranged in the matrix shape. FIG. 3B is a schematic view describing a circuit configuration of each optical sensor.

Referring to FIG. 3A, reading pixels 61 arranged in one column line are connected to word lines 63 respectively, and the word lines 63 are connected to a column decode line 67 through word-line selectors 70. The reading pixels 61 arranged in one row line are connected to bit lines 64, and the bit lines 64 are connected to a row decode line 69 through bit-line selectors 71. The column decode line 67 and the row decode line 69 are connected to image processing unit 58. A current of the predetermined reading pixel 61 is read by specifying addresses of the column decode line 67 and row decode line 69. A position (state) of the sheet located on the sheet scanner may be detected by reading the current of each reading pixel 61. Referring to FIG. 3B, each reading pixel 61 is formed by a combination of an organic transistor 61*a* and an organic photodiode 61*b*.

Because the reading pixel which is of the photoelectric conversion device is formed by the organic semiconductor devices such as the organic transistor and the organic photodiode, the reading pixel may be formed on the flexible guide assist member by utilizing, e.g., a precise printing technique. Additionally, because the number of reading-pixel lines may arbitrarily and selectively be formed in the row or column direction, the one-line sensor array may easily be formed in the sheet conveyance direction.

The reading operation of the sheet scanner having the above configuration is performed as follows. The sheet P which is of a subject is conveyed along the guide members 32 and 33, and the sheet P comes into contact with the lower surface of the guide assist member 81. The guide assist member 81 has a translucent property, and the light reaches the sheet P through gaps of the reading pixels 61 arranged in the matrix shape when the guide assist member 81 is irradiated with the light. The light is reflected according to brightness and darkness of the sheet P, and the reflected light is incident to the reading pixel 61. Photoelectric conversion is performed by the reading pixel 61, and the image of the sheet P is read by reading the photoelectric conversion signal. The light with which the guide assist member 81 is irradiated from above reaches the guide member or the sheet, and the light is reflected. Therefore, the presence or absence of the sheet P or the position of the end portion is read.

Thus, the sheet scanner 80 which is of the sheet detection sensor is provided in the guide assist member 81.

A leading end image signal of the sheet P which is detected by the sensor 80 provided in the guide assist member 81 is transmitted to the image processing unit 58. An image write signal is transmitted to the image forming unit 3 in synchronization with the position of the sheet P, which allows the image to be formed at the proper position of the sheet P.

Although the free end 81*b* of the guide assist member 81 is in contact with the guide member 33 in the configuration of the first embodiment, the invention is not limited to the first embodiment. For example, as long as the sheet P is in contact with the guide assist member 81, it is not always necessary that the free end 81*b* be in contact with the guide member.

The sheet scanner 80 may be provided as necessary. For example, the sheet scanner 80 may be formed in the whole area in a longitudinal direction (orthogonal to the sheet conveyance direction) of the guide assist member 81, or the sheet scanner 80 may partially be provided in both the end portions or in a central portion in the longitudinal direction.

According to the first embodiment, the sheet detection sensor 80 is provided in the guide assist member 81 by arranging the photoelectric conversion devices 61 formed by the organic semiconductor devices. Therefore, it is not necessary to provide the lever type sensor or optical sensor which is provided independently of the guide assist member, so that the space-saving may be realized. Additionally, the accuracy of sheet detection is improved because the sheet is detected at the same position by the sheet scanner 80 while the flutter of the sheet is restrained by the flexible guide assist member 81. Therefore, the fluctuation of image write position to the sheet may be restrained to realize the high image quality.

Second Embodiment

Figure 4:
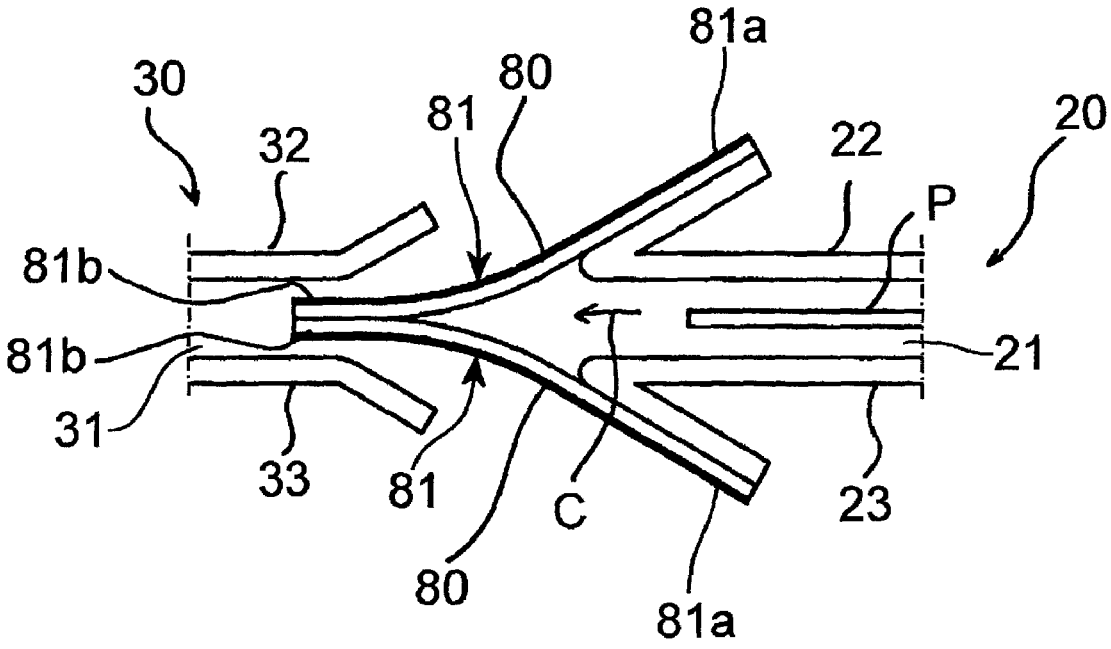
FIG. 4 is a detailed sectional view illustrating a sheet conveyance device according to a second embodiment.
Figure 5:
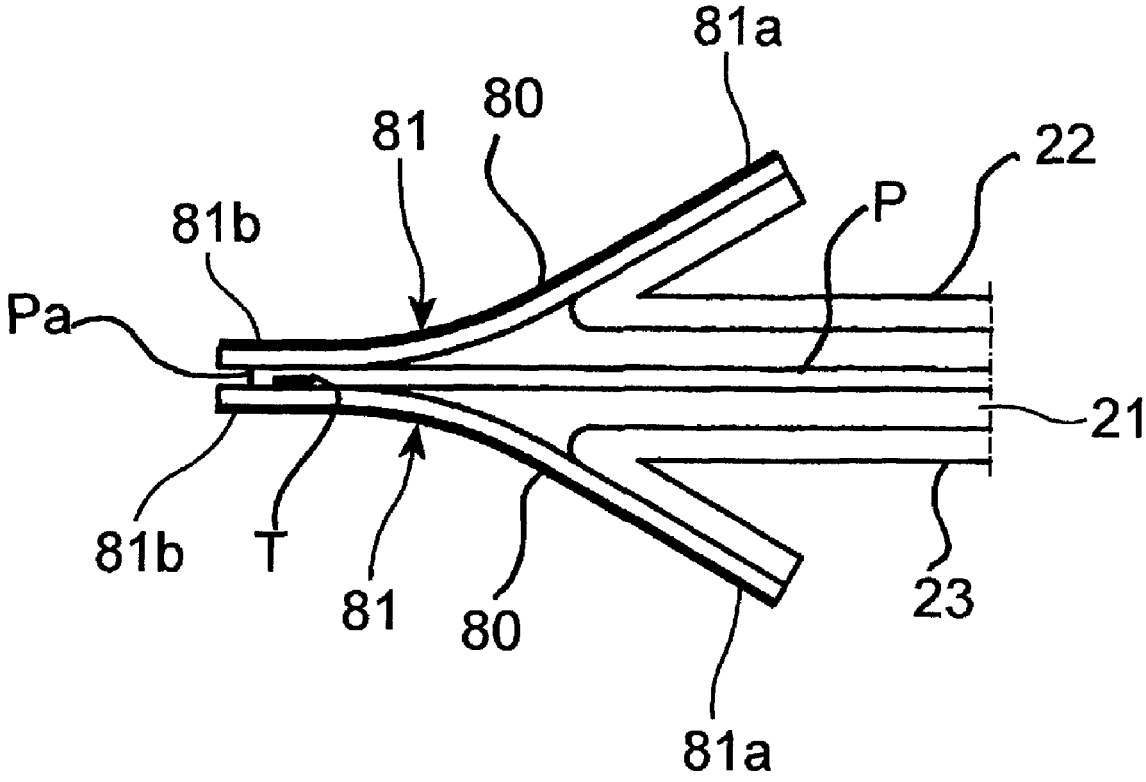
FIG. 5 is a detailed sectional view illustrating the sheet conveyance device of the second embodiment.

A sheet conveyance device according to a second embodiment will be described with reference to FIGS. 4 and 5. FIGS. 4 and 5 illustrate the detailed configuration around the sensor 80 of FIG. 1. The configurations except for the area around the sensor 80 are similar to those of the first embodiment, so that detailed description is neglected.

Referring to FIG. 4, the sheet scanner which is of the sheet detection sensor 80 is located in a coupling portion between the first conveyance path 21 of the first conveyance unit 20 and the second conveyance path 31 of the second conveyance unit 30.

Each conveyance unit is configured to be drawn in a direction orthogonal to the sheet conveyance direction with respect to a main body of the image forming apparatus. Accordingly, the first conveyance unit 20 having the first conveyance path 21 and the second conveyance unit 30 having the second conveyance path 31 may be respectively drawn to the front side of the apparatus main body to remove the sheet from the conveyance paths during the jam.

In each of the pair of guide members 22 and 23 constituting the first conveyance path 21, the flexible guide assist member 81 which may be elastically deformed is provided while the sheet scanner 80 is formed on the surface of the guide assist member 81. Each guide assist member 81 is inclined toward the conveyance direction of the sheet P (arrow C direction), and the end portions 81*a* are provided in the guide members 22 and 23 while the other end portions 81*b* constitute the free end respectively. As shown in FIG. 4, the free ends 81*b* of the guide assist members 81 are oppositely disposed so as to be brought into contact with each other.

The guide assist member 81 in which the end portions 81*a* are provided in the guide members 22 and 23 are disposed such that the free ends 81*b* which are of the other end overlap the guide members 32 and 33 of the adjacent second conveyance path 31 of the second conveyance unit 30. That is, the guide assist member 80 having the sheet scanner 80 is provided from the adjacent conveyance unit 20 to the adjacent conveyance unit 30.

As shown in FIG. 5, the sheet P is conveyed between the sensors 80 which are located between the guide assist members 81 facing each other, and the end portion of the sheet P is detected, which synchronizes the sheet conveyance timing with the image formation as described in the first embodiment.

In the second embodiment, when the image is formed in the second surface in the double-sided print mode, one of the sensors 81 detects a sheet end portion Pa and an image end portion T in the image formation on the first surface. Then, a distance between the sheet end portion Pa and the image end portion T is computed, and the image is formed at image write timing of the second surface in consideration of the distance.

As shown in FIG. 4, in the configuration in which the free ends 81*b* of the guide assist members 81 facing each other are in contact with each other, one of the guide assist members 81 located on the surface side of the sheet may have no detecting function, namely, the guide assist member 81 may be a guide assist member having no sensor 80.

Figure 6:
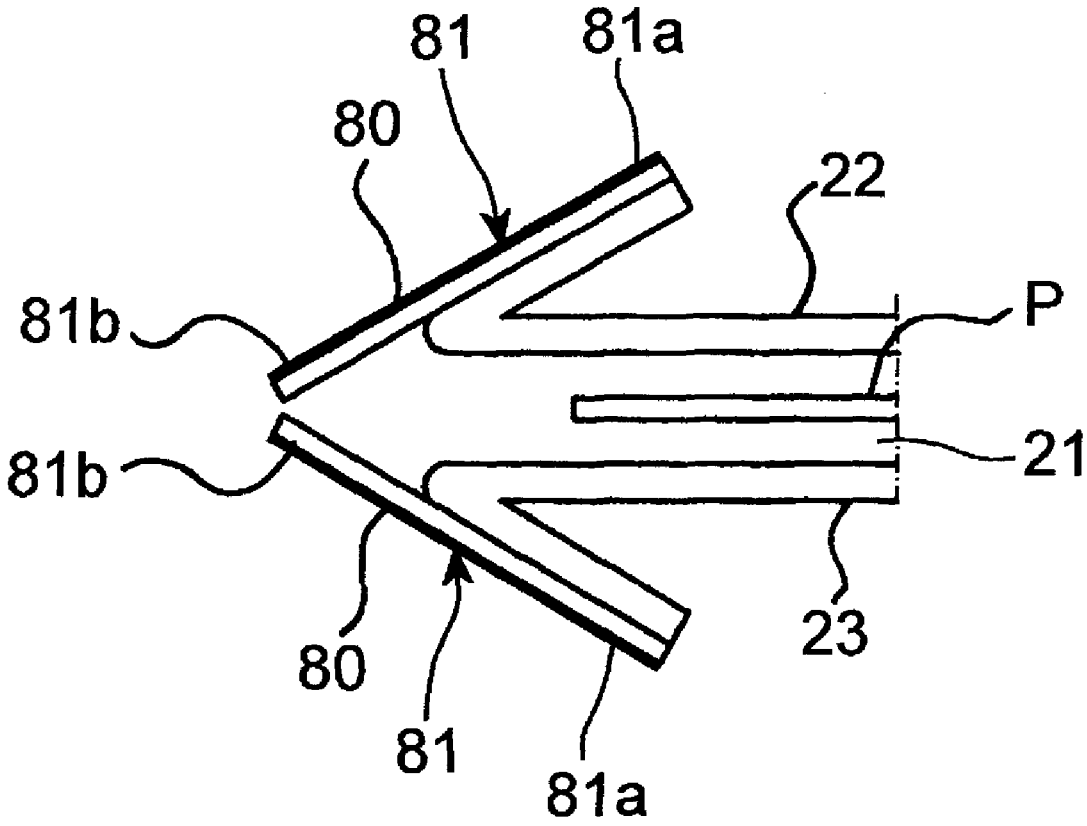
FIG. 6 is a detailed sectional view illustrating the sheet conveyance device of the second embodiment.

In FIGS. 4 and 5, the guide assist members facing each other are in contact with each other. However, the invention is not limited to the guide assist members of FIGS. 4 and 5. For example, as shown in FIG. 6, the free ends 81*b* of the guide assist members 81 facing each other may be separated from each other. In the configuration in which the free ends 81*b* of the guide assist members 81 facing each other are separated from each other as shown in FIG. 6, because it is unknown that the conveyed sheet P first comes into contact with which free ends 81*b*, desirably both the guide assist members facing each other have the sensor functions.

According to the second embodiment, in addition to the effect of the first embodiment, the image position of the first surface may accurately be synchronized with the image position of the second surface in the double-sided print mode. Even if the relative position between the first conveyance path 21 and the second conveyance path 31 is slightly shifted due to the accuracy of component assembly, the generation of the jam may be prevented because the sheet P is guided close to the second conveyance path 31 by the guide assist members facing each other.

When the second conveyance path 31 is drawn in a jam clearance operation, the sensor of the guide assist member disposed in the coupling portion detects whether or not the sheet is stopped while straddling first conveyance path 21 and the second conveyance path 31. Therefore, cost reduction may be realized because it is not necessary that the sensors be provided in the first conveyance path 21 and the second conveyance path 31 respectively.

Third Embodiment

Figure 7:
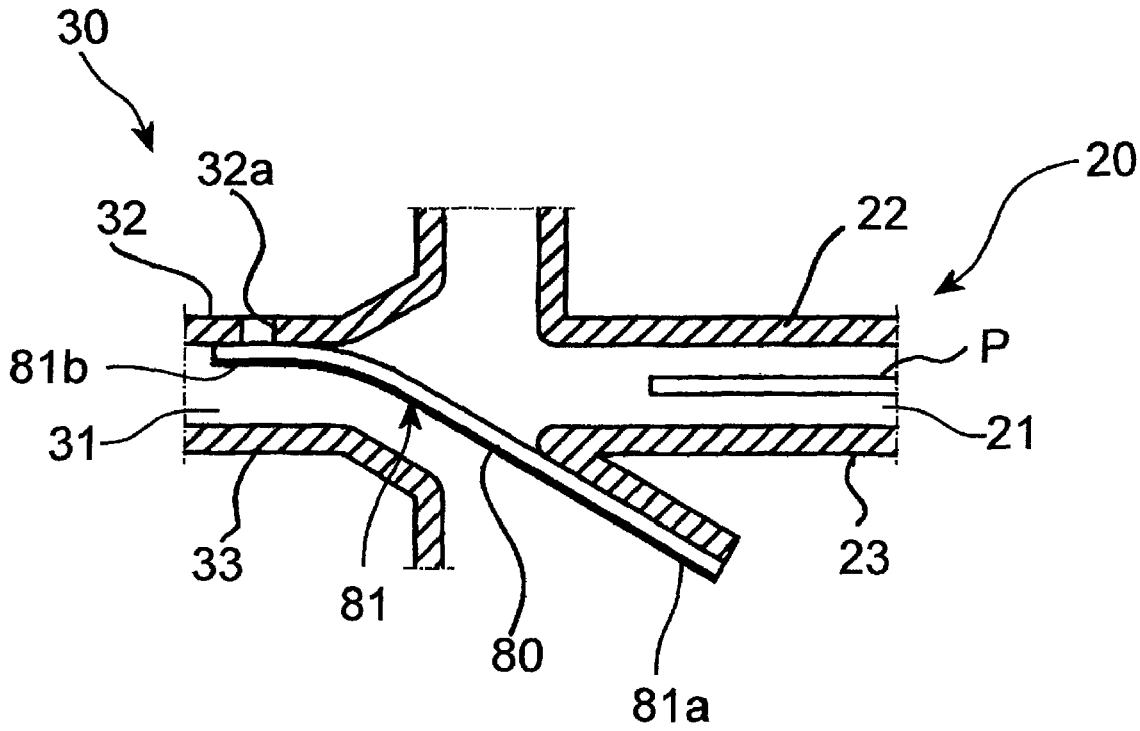
FIG. 7 is a detailed sectional view illustrating a sheet conveyance device according to a third embodiment.

A sheet conveyance device according to a third embodiment will be described with reference to FIG. 7. FIG. 7 illustrates the detailed configuration around the sensor 80 of FIG. 1. The configurations except for the area around the sensor 80 are similar to those of the above embodiments, so that detailed description is neglected.

Referring to FIG. 7, the sheet scanner which is of the sheet detection sensor 80 is located in a coupling portion between the first conveyance path 21 of the first conveyance unit 20 and the second conveyance path 31 of the second conveyance unit 30.

The first conveyance unit 20 is configured to be able to be drawn onto the right side of the apparatus with respect to the image forming apparatus main body to remove the sheet from the conveyance paths during the jam. Accordingly, the first conveyance unit 20 having the first conveyance path 21 is drawn in the direction in which the first conveyance unit 20 is separated away from the second conveyance unit 30 having the second conveyance path 31.

In the guide members 22 and 23 constituting the first conveyance path 21, the flexible guide assist member 81 is provided in the end portion of the guide member 23 while the sheet scanner 80 is formed on the surface of the guide assist member 81. The guide assist member 81 is inclined toward the conveyance direction of the sheet P (arrow C direction), the end portion 81*a* is provided in the guide member 23, and the end portion 81*b* constitutes the free end. As shown in FIG. 7, the free end 81*b* of the guide assist member 81 is disposed which brought into contact with the adjacent guide member 32 constituting the second conveyance path 31 of the second conveyance unit 30.

An index hole 32*a* is made in the guide member 32 within a range where the guide assist member 81 is brought into contact with the guide member 32. Accordingly, when the first conveyance unit 20 is coupled to the second conveyance unit 30, the guide assist member 81 is brought into contact with the guide member 32 of the second conveyance unit 30, and the sensor 80 provided in the guide assist member 81 detects the index hole 32*a* made in the guide member 32. Then, the distance between the conveyance units 20 and 30 adjacent to each other is computed, and the image is formed at image write timing in consideration of the distance.

According to the third embodiment, the amount of fluctuation is corrected even if the fluctuation of the position is generated due to the detachable attachment of the conveyance unit. Therefore, even if the conveyance path straddle the detachable conveyance units, the fluctuation of image write position to the sheet may be restrained to realize the high image quality.

Other Embodiments

Although the printer is illustrated as the image forming apparatus in the above embodiments, the invention is not limited to the printer. Examples of the image forming apparatus include a scanner, a copying machine, a facsimile, and a multifunction peripheral in which these functions are combined. The same effects may be obtained by applying the invention to the sheet conveyance device used in these pieces of image forming apparatus.

Although the sheet conveyance device which is detachably attached to the image forming apparatus is illustrated in the above embodiments, the invention is not limited to the above embodiments. For example, the sheet conveyance device may be integral with the image forming apparatus. The same effects may be obtained by applying the invention to the sheet conveyance device.

In the above embodiments, all the detachable conveyance units are illustrated in the apparatus in which the conveyance path is divided into the plural conveyance paths. However, the invention is not limited to the above embodiments. Only a part of the plural conveyance units may have the detachable configuration. Although the sheet conveyance device for conveying the sheet such as the recording paper of the recording target is illustrated in the above embodiments, the invention is not limited to the above embodiments. For example, the same effects may be obtained by applying the invention to the sheet conveyance device for conveying the sheet such as the original of the read target to the image forming apparatus.

Although the recording type of the image forming unit is not specifically illustrated in the above embodiments, for example, the electrophotographic system and inkjet recording type may appropriately be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-214667, filed Aug. 7, 2006 which is hereby incorporated by reference herein in its entirety.

The invention claimed is:

1. A sheet conveyance device comprising:

a conveyance path which guides a conveyed sheet;

a flexible guide assist member, having a translucent property, and which is provided in the conveyance path to assist guidance of the conveyed sheet, and a sheet detection unit which detects the conveyed sheet, wherein the sheet detection unit is formed on the flexible guide assist member and consists of photoelectric conversion devices formed by organic semiconductor devices, wherein the sheet detection unit detects a light reflected by the conveyed sheet through the flexible guide assist member.

2. The sheet conveyance device according to claim 1, wherein the conveyance path has a pair of guide members, the flexible guide assist member is provided such that one end portion of the flexible guide assist member is fixed to one of the pair of guide members while an other end portion of the flexible guide assist member constitutes a free end.

3. The sheet conveyance device according to claim 2, wherein the free-end side of the flexible guide assist member is in contact with the other guide member.

4. The sheet conveyance device according to claim 2, further comprising a second flexible guide assist member, wherein the flexible guide assist members are provided in the pair of guide members constituting the sheet conveyance path respectively, and free-end sides of the flexible guide assist members are extended toward sheet conveyance direction while facing each other.

5. The sheet conveyance device according to claim 1, wherein the sheet detection unit provided in the flexible guide assist member reads a sheet end portion and an image position of the sheet.

6. An image forming apparatus has a sheet conveyance device which conveys a sheet in which an image is already formed in an image forming portion or a sheet in which an image is formed in the image forming portion, the image forming apparatus comprising:

a conveyance path which guides a conveyed sheet;

a flexible guide assist member, having a translucent property, and which is provided in the conveyance path to assist guidance of the conveyed sheet, and a sheet detection unit which detects the conveyed sheet, wherein the sheet detection unit is formed on the flexible guide assist member and consists of photoelectric conversion devices formed by organic semiconductor devices, wherein the sheet detection unit detects a light reflected by the conveyed sheet through the flexible guide assist member.

7. An image reading apparatus has a sheet conveyance device which conveys an original which is already read by an image reading portion or an original which is read by the image reading portion, the image reading apparatus comprising:

a conveyance path which guides a conveyed sheet;

a flexible guide assist member, having a translucent property, and which is provided in the conveyance path to assist guidance of the conveyed sheet, and a sheet detection unit which detects the conveyed sheet, wherein the sheet detection unit is formed on the flexible guide assist member and consists of photoelectric conversion devices formed by organic semiconductor devices, wherein the sheet detection unit detects a light reflected by the conveyed sheet through the flexible guide assist member.

* * * * *